US011530692B2

(12) United States Patent
Roider

(10) Patent No.: US 11,530,692 B2
(45) Date of Patent: Dec. 20, 2022

(54) HYDRAULIC PRESSURE SUPPLY UNIT

(71) Applicant: HAWE Altenstadt Holding GmbH, Altenstadt (DE)

(72) Inventor: Peter Roider, Lappersdorf (DE)

(73) Assignee: HAWE ALTENSTADT HOLDING GMBH, Altenstadt (DE)

( * ) Notice: Subject to any disclaimer, the term of this patent is extended or adjusted under 35 U.S.C. 154(b) by 42 days.

(21) Appl. No.: 16/765,426

(22) PCT Filed: Nov. 19, 2018

(86) PCT No.: PCT/EP2018/081709

§ 371 (c)(1),
(2) Date: May 19, 2020

(87) PCT Pub. No.: WO2019/101674

PCT Pub. Date: May 31, 2019

(65) Prior Publication Data

US 2020/0318623 A1 Oct. 8, 2020

(30) Foreign Application Priority Data

Nov. 23, 2017 (DE) ..... 102017127675.0

(51) Int. Cl.
*F04B 23/02* (2006.01)
*F04B 17/03* (2006.01)
*F04B 53/08* (2006.01)

(52) U.S. Cl.
CPC ..... *F04B 23/023* (2013.01); *F04B 17/03* (2013.01); *F04B 53/08* (2013.01)

(58) Field of Classification Search
CPC ..... F04B 17/03; F04B 23/021–023; F04B 53/08; F04B 53/16
(Continued)

(56) References Cited

U.S. PATENT DOCUMENTS 2,675,759 A * 4/1954 Yarger ..... F04B 53/126 417/307
5,360,322 A * 11/1994 Henein ..... B60G 17/0152 417/313
(Continued)

FOREIGN PATENT DOCUMENTS

DE 29609701 U1 8/1996
DE 19513286 B4 10/2006
(Continued)

OTHER PUBLICATIONS

International Search Report dated Jan. 29, 2019; International Application No. PCT/EP2018/081709.

*Primary Examiner* — Alexander B Comley
(74) *Attorney, Agent, or Firm* — Dinsmore & Shohl LLP

(57) ABSTRACT

A hydraulic pressure supply unit has a storage chamber which stores hydraulic fluid, a hydraulic pump which is arranged within the storage chamber and dips at least partially into the stored hydraulic fluid, and an electric motor which drives the hydraulic pump. The electric motor is arranged below the hydraulic pump in a separate motor chamber which is situated below the storage chamber, is dry, and is not connected fluidically to the storage chamber. The electric motor is coupled in a thermally transmitting manner to a separating floor, the upper side of which delimits the storage chamber and is wetted continuously with stored hydraulic fluid.

13 Claims, 4 Drawing Sheets

(58) Field of Classification Search
USPC ..... 417/423.3, 423.14, 424.1
See application file for complete search history.

(56) References Cited

U.S. PATENT DOCUMENTS 6,132,184 A * 10/2000 Robertson ..... F04D 13/06 417/366
6,158,983 A * 12/2000 Harpole ..... B62D 5/062 310/67 R
6,183,213 B1 * 2/2001 Robertson ..... B62D 5/064 417/312
6,287,090 B1 * 9/2001 Hamasaki ..... F01C 21/10 417/360
6,322,329 B1 * 11/2001 Vera ..... F02M 37/0041 417/313
6,506,029 B1 * 1/2003 Reichenmiller ..... F04C 11/00 181/241
6,524,084 B2 2/2003 Neumair
6,592,336 B1 * 7/2003 Hirano ..... F04B 53/16 417/201
7,488,160 B2 * 2/2009 Jordan ..... F04C 2/18 417/423.14
7,488,162 B2 * 2/2009 Jordan ..... F04C 2/18 418/132
7,799,074 B2 * 9/2010 Grimme ..... F04C 2/082 623/3.24
8,133,037 B2 * 3/2012 Fischer ..... F04C 15/0042 417/312
8,591,203 B2 * 11/2013 Yoshihara ..... F04B 11/0008 417/423.14
2006/0090639 A1 * 5/2006 Dong ..... F04B 23/023 91/505

FOREIGN PATENT DOCUMENTS

EP 0857871 A1 8/1998
EP 2241753 A1 10/2010
FR 2480865 A1 10/1981
GB 1329395 A 9/1973

* cited by examiner

HYDRAULIC PRESSURE SUPPLY UNIT

CROSS-REFERENCE TO RELATED APPLICATIONS

This application is the U.S. national stage of PCT/EP2018/081709 filed Nov. 19, 2018, which claims priority of German Patent Application 102017127675.0 filed Nov. 23, 2017 both of which are hereby incorporated by reference in their entirety.

FIELD OF THE INVENTION

The present invention relates to a hydraulic pressure supply unit comprising a hydraulic fluid reservoir, a hydraulic pump arranged within the reservoir and at least partially immersed in the stored hydraulic fluid, and an electric motor driving the hydraulic pump.

BACKGROUND OF THE INVENTION

Hydraulic pressure supply units of the above-mentioned type are known in various designs and are used in hydraulic systems of various types. Only by way of example, reference should be made to GB 1329395 A, U.S. Pat. No. 6,524,084 B2, U.S. Pat. No. 6,592,336 B1, U.S. Pat. No. 6,132,184 A, EP 857871 A1, DE 19513286 B4 and DE 29609701 U1.

Depending on the individual application-specific requirements, the hydraulic pressure supply units differ in concept and/or construction. For example, according to U.S. Pat. No. 6,132,184 A, the hydraulic pressure supply unit has a horizontal axis, i.e. the electric motor is located alongside to the hydraulic pump driven by it. The motor shaft passes through a base body on which a space is formed which is bounded by an annular wall and which accommodates the pump arrangement. A motor housing is attached to the base body on one side and a pump housing is attached to the base body on the other side, wherein the pump housing together with the base body also defines and limits a tank volume. The control of the pressure supply unit is accommodated in a space arranged at the top of the pump housing, which is delimited by a saucer-type section of the pump housing and a cover placed on top of it.

EP 857871 A1 also discloses a hydraulic pressure supply unit with a horizontal axis. The electric motor, which is mounted directly on a base body opposite a pump support, is surrounded by a tubular motor housing that is connected to the base body in a sealed manner. This forms the inner wall of a tank which surrounds the electric motor in a ring shape and is externally limited by a tubular shell which is in turn attached to the base body in a sealing manner.

In the hydraulic pressure supply unit according to GB 1329395 A, a housing is divided by a partition wall into an upper and a lower section. The lower section houses a hydraulic unit with a tank, a hydraulic pump located in it and surrounded by the hydraulic fluid and an electric motor mounted on top of the tank. To attach the electric motor and the hydraulic pump to the upper tank wall, a motor support is mounted on top of the upper tank wall and a pump support is attached to the bottom of the upper tank wall. The vertically oriented motor shaft passes through the motor support, the upper tank wall and the pump support. The tank is smaller than the lower section of the housing, so that cooling air can circulate around the tank under the influence of a fan located in the upper section of the housing through openings provided in the partition wall.

Another hydraulic pressure supply unit with vertical axis, namely with an electric motor arranged above the pump, is known from EP 2241753 A1. A tubular base housing closed at the top and bottom by a cover is divided into an upper and a lower section by a heat transfer ring molded to the inside of the base housing and a support plate mounted to the heat transfer ring. The electric motor is accommodated in the upper section, namely it is inserted into a stator insertion seat constructed on the heat transfer ring. The lower section comprises an oil reservoir, which also houses the hydraulic pump mounted on the bottom of the support plate.

The individual application-specific requirements already mentioned above, which influence the concept and/or construction of the hydraulic pressure supply unit, include, for example, the power requirement, the available space and the installation situation in general including accessibility for maintenance purposes and possibilities for heat dissipation, the typical usage profile with regard to continuous or intermittent operation. Additional practical aspects are energy efficiency, reliability, manufacturing costs, etc.

SUMMARY OF THE INVENTION

The present invention has set itself the task of providing a hydraulic pressure supply unit of the type mentioned at the beginning, which is better suited than previously known pressure supply units for use as a hydraulic aggregate for hydraulic steering drives of watercraft and which meets the existing practical requirements in an outstanding manner.

The present task is solved by a hydraulic pressure supply unit corresponding to the type specified at the beginning, which is further characterized by the following combination of mutually interacting features:

- the electric motor is arranged below the hydraulic pump in a separate motor compartment located below the reservoir;
- the motor compartment is dry and is not in fluid communication with the hydraulic fluid reservoir;
- at least one further electrical component is accommodated in the motor compartment;
- the electric motor is coupled in a heat-conducting manner to a partition base, the upper side of which delimits the hydraulic fluid reservoir and is constantly wetted with stored hydraulic fluid.

The motor concept in accordance with the invention has an outstanding influence in particular on the possibilities of optimizing the heat balance even under unfavorable conditions, such as those encountered in the application environment of particular interest here, while at the same time favoring the possibilities of integrating the hydraulic pressure supply unit into this very application environment. This is because the hydraulic fluid is used for effective dissipation of the electric motor's heat loss. However, this does not take place in accordance with the widely used concept (cf. for example DE 29609701 U1 and DE 19513286 B4), in which the electric motor is designed as an oil-immersed motor, i.e. cooled directly by the hydraulic fluid. Rather, in the hydraulic pressure supply unit according to the invention, in which the hydraulic pump is arranged above the electric motor driving it, heat is dissipated from the electric motor arranged in a dry motor compartment via a partition base, below which the electric motor is arranged and to which it is coupled in a heat-conducting manner, into the hydraulic fluid, which is stored in the reservoir and wetting the partition base on its upper side. The hydraulic fluid present in the reservoir thus acts as a kind of cooling medium for the partition base. As a result of the construction of the pressure supply unit according to the invention, a kind of natural convection is established in the hydraulic fluid stored in the reservoir; this transports the heat to the exposed outer wall of the reservoir, wherein—due to the comparatively large possible heat transfer surfaces—high efficiency can be achieved and local temperature peaks can be effectively avoided.

According to the invention, the dry motor compartment provided—below the partition base—for the accommodation of the electric motor is further used for the protected (from splash water etc.) accommodation of other functionally relevant electrical components, such as electronic assemblies. This is an inestimable advantage for the reliability of the overall system, especially since in addition to the protection of the electrical components accommodated in the motor compartment against moisture and other environmental influences, a particularly effective shielding is possible in this way, which is beneficial to the EMC compatibility of the hydraulic pressure supply unit. The achievable thermotechnical advantages are particularly pronounced when accommodating such additional electrical components in the motor compartment, which also generate a considerable amount of heat loss. In particular, they can be coupled in a heat-conducting manner with the partition base and/or a wall portion laterally delimiting the motor compartment, the latter having cooling fins on its outer surface in a particularly preferred embodiment.

In accordance with a first preferred embodiment of the invention, the partition base is connected in a heat-conducting manner to a housing part which circumferentially delimits the hydraulic fluid reservoir. It is particularly advantageous if the said housing part has cooling fins on its outside. This ensures reliable redundant dissipation of the heat loss generated in the electric motor, namely on the one hand from the partition base via the hydraulic fluid into the housing part and on the other hand via direct heat transfer from the partition base into the housing part, wherein the cooling fins preferably provided on the housing part ensure efficient and reliable dissipation of the heat loss generated in the electric motor to the environment.

For certain applications, it may be advantageous if the aforementioned housing part, in a further preferred embodiment, extends downwards beyond the partition base and also circumferentially delimits the motor compartment, wherein the partition base is inserted inside the housing part. In this case, it is not necessary to join two separate housing parts which delimit the reservoir on the one hand and the motor compartment on the other hand; and there may also be thermal advantages in that there is a favorable heat flow through the continuous housing part which extends both upwards and downwards in relation to the partition base, with the additional possibility of cooling fins extending continuously along the level of the hydraulic fluid reservoir and the motor compartment.

For other applications, on the other hand, a different concept of the constructive implementation of the present invention offers decisive advantages, in which the partition base is constructed in the manner of a carrier plate, on which not only—on different sides—the hydraulic pump and the electric motor are attached, but in which also—by means of corresponding built-in elements (channels, lines, throttles, valves, filters, etc.)—hydraulic functionalities are integrated. In this case, preferably, a first housing part, which laterally delimits the hydraulic fluid reservoir, is attached to the top of the carrier plate partition base and a separate second housing part, which laterally delimits the motor compartment, is attached to the bottom. Between the two housing parts, the carrier plate partition base is accessible at the circumference. This allows in particular the electrical and hydraulic interfaces of the pressure supply unit, i.e. the electrical power and control connections as well as the hydraulic connections, to be located on the side of the partition base. In this way, openings in the housing parts can be avoided. For favorable conditions with regard to heat transfer and heat dissipation, the carrier plate partition base can be made of aluminum in particular.

In a further preferred embodiment, the mentioned housing part (resp. each of the mentioned housing parts) has a cylindrical—which does not necessarily mean circular-cylindrical—basic shape. In particular, it (or each of them) can be formed by a section of a profile tube—for example, manufactured as an extruded profile made of aluminum. In the sense described above, the housing part may form a continuous housing shell. At the ends, the one continuous housing part or both separate housing parts can be closed by two covers. At least one of these covers can be configured as a mounting plate and have at least one fastening portion extending radially beyond the housing shell, in particular a flange-like fastening portion.

Very simple and compactly constructed units can be realized, according to another preferred embodiment of the invention, by aligning the motor axis and the pump axis, wherein the electric motor and the hydraulic pump can be directly coupled to each other, in particular via a shaft arrangement penetrating the partition base.

In particular in such embodiments in which the partition base as a whole is not constructed in the form of a carrier plate (see above), a separate socket with an integrated line and valve arrangement may be connected to the partition base, on which the hydraulic pump is placed, wherein the motor-pump-shaft arrangement also penetrates that socket. A projection of the socket or the socket as such may pass through an opening in the partition base. In particular, the electric motor can have a flange connected to the front side of the socket or the socket projection, wherein it is particularly advantageous if that flange is fixed to the underside of the partition base with a protrusion that protrudes beyond the socket projection. This allows direct mechanical coupling of the electric motor—via its flange—to the partition base, which favors heat dissipation. If the opening of the partition base is substantially larger than the socket projection, so that a gap (especially an annular one) remains, the gap is flooded with hydraulic fluid. The hydraulic fluid thus cools the socket projection on its outside immediately adjacent to its connection to the electric motor, which facilitates efficient heat dissipation with as small local temperature differences within the pressure supply unit as possible. In a further preferred embodiment, a side wall of the socket with a pressure outlet can face a wall that delimits the hydraulic fluid reservoir, wherein the pressure outlet of the socket communicates with a pressure connection provided on the reservoir wall.

BRIEF DESCRIPTION ON THE DRAWINGS

In the following, the present invention is explained in more detail by means of two preferred embodiments illustrated in the drawing. Therein it is shown FIG. 1 is a frontal view of a pressure supply unit according to a first embodiment;

DETAILED DESCRIPTION OF THE INVENTION

Figure 1:
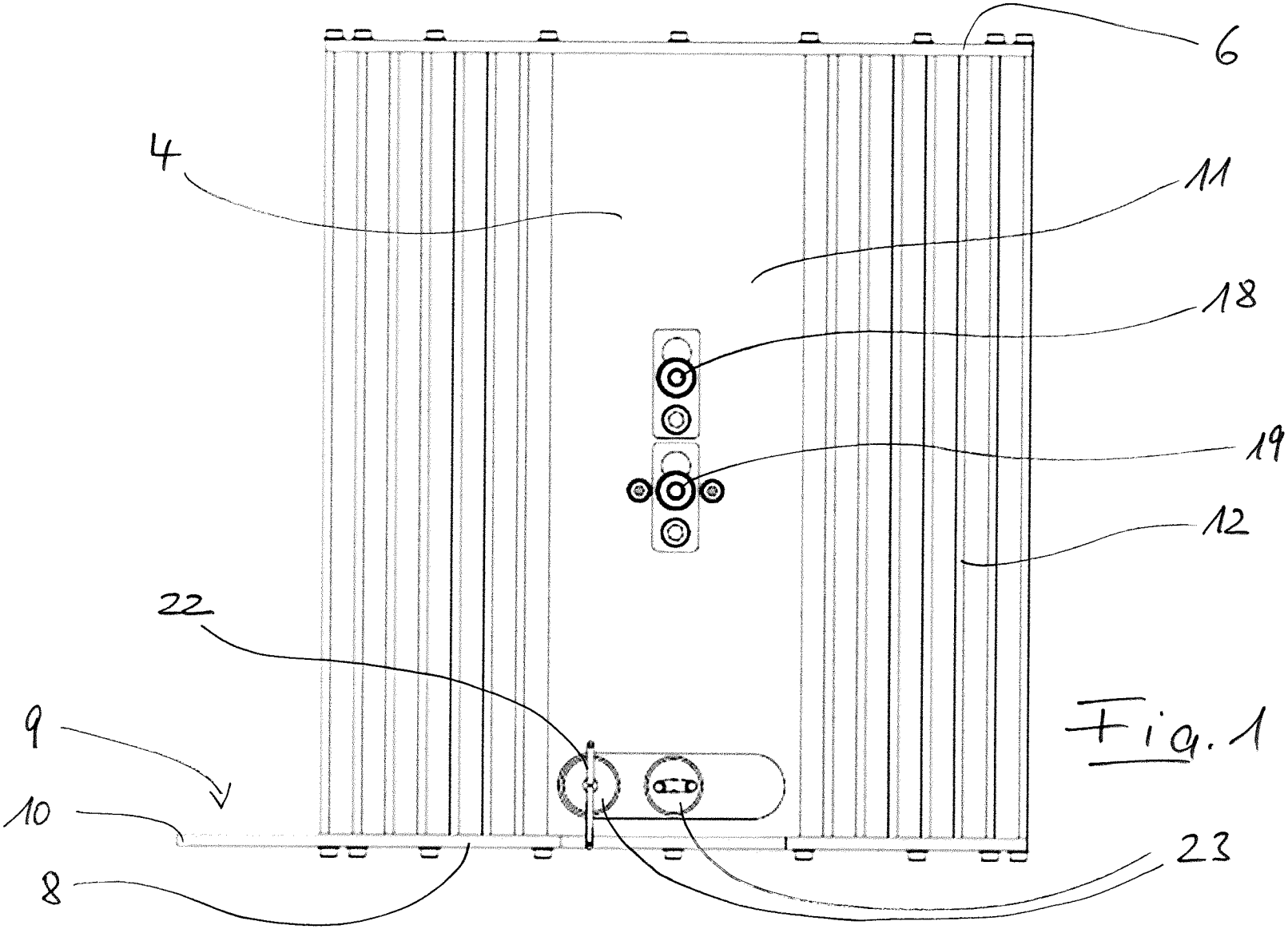
Figure 2:
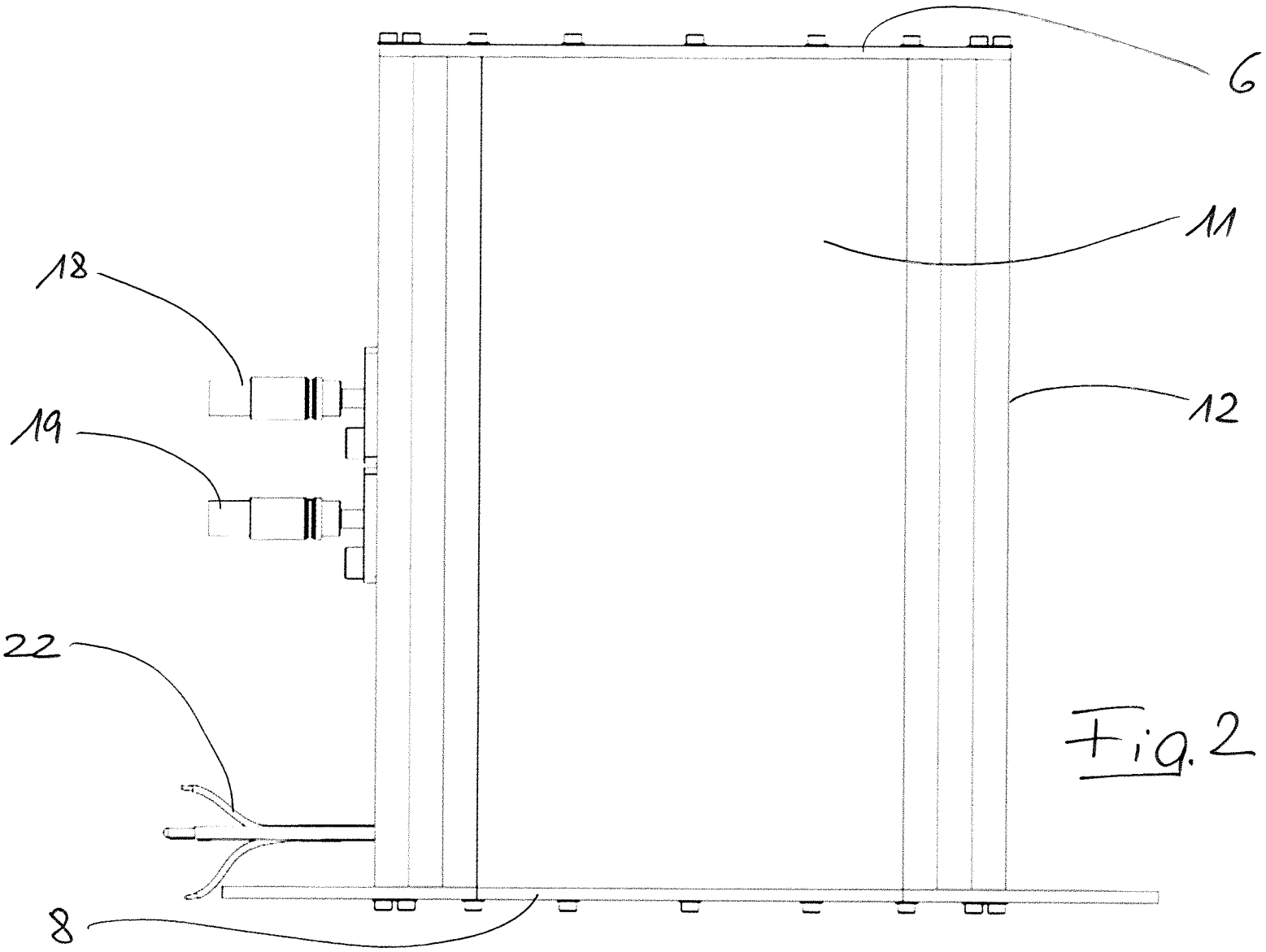
FIG. 2 is a side view of the pressure supply unit according to FIG. 1.
Figure 3:
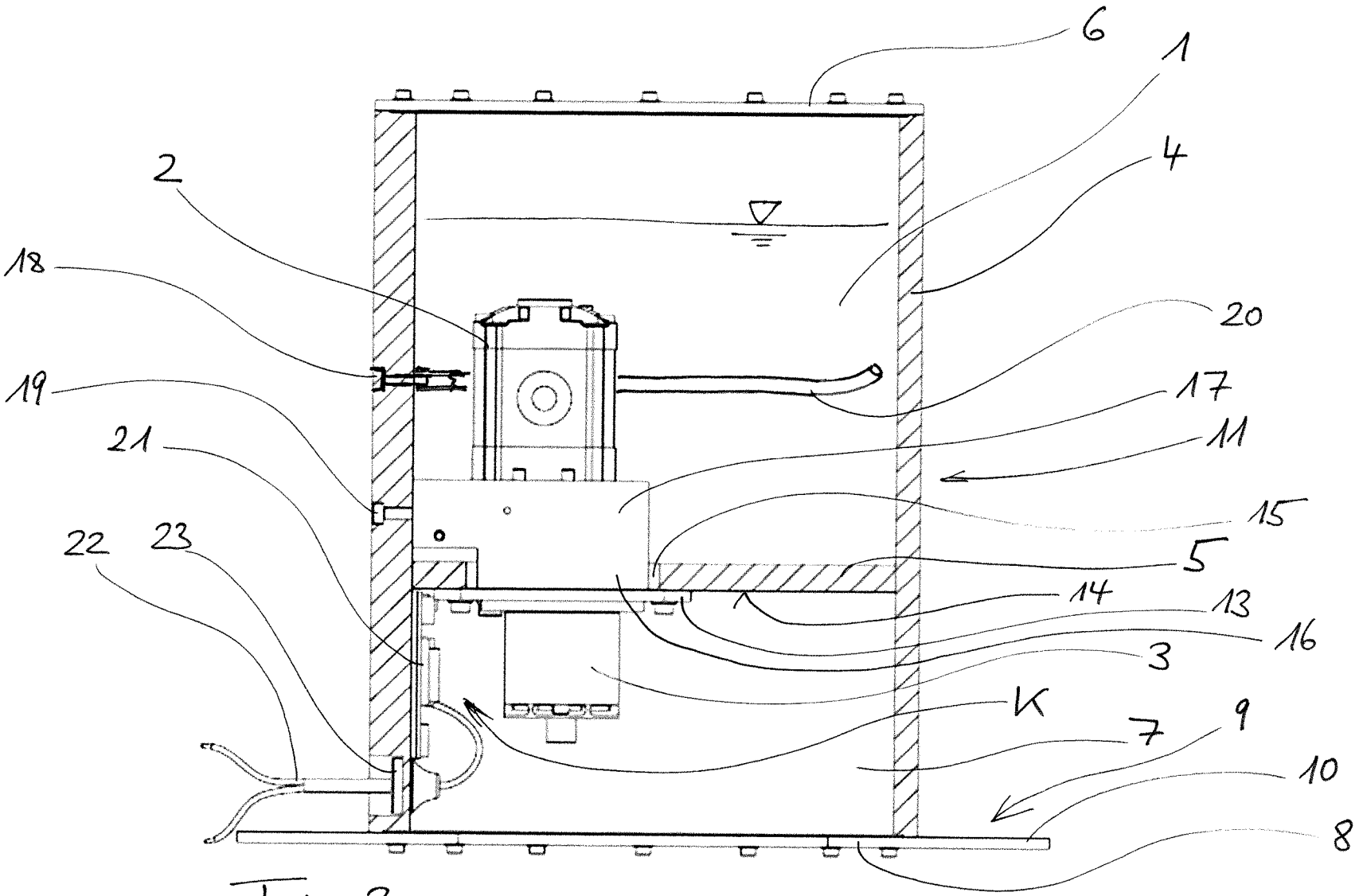
FIG. 3 is a sectional view of the pressure supply unit according to FIGS. 1 and 2.

The hydraulic pressure supply unit shown in FIGS. 1 to 3 of the drawing has as main components a reservoir 1 storing hydraulic fluid, a hydraulic pump 2 located inside the reservoir 1 and immersed in the stored hydraulic fluid, and an electric motor 3 driving the hydraulic pump 2. In this respect, it corresponds to conventional, known hydraulic pressure supply units of the concept relevant here, so that no further explanations are required in this respect.

The reservoir 1 is delimited laterally by a housing part 4, downward by a partition base 5 inserted into the housing part 4 and upward by a fitted upper cover 6. The partition base 5 is connected to the housing part 4 in a heat-conducting and fluid-tight manner. The housing part 4 has an oval-cylindrical basic shape. It is formed of a section of extruded aluminum profile tube. It extends downwards beyond the partition base 5 and delimits on the circumference a separate motor compartment 7 arranged below the partition base 5, which in turn is closed downwards by a lower cover 8, which is configured as a mounting plate 9 and has a fastening portion 10 extending radially beyond the profile tube. In this way, the housing part 4 forms a continuous housing shell 11. Cooling fins 12 provided on the outside of the housing shell 11 extend continuously along the level of the reservoir 1 for hydraulic fluid and the motor compartment 7.

The motor compartment 7 is dry and is not fluidically connected to the reservoir 1 for hydraulic fluid. The electric motor 3 driving the hydraulic pump 2 is accommodated in it, below the hydraulic pump 2. The electric motor 3 is coupled to the partition base 5 in a heat-conducting manner. For this purpose, it is attached to the partition base 5 by means of a flange 13, which lies flat against the underside 14 of the partition base 5 along an annular surface.

Above the electric motor 3, the partition base 5 has an opening 15. Through this opening 15 passes with a corresponding projection 16 a socket 17, in which a line and valve arrangement is accommodated and on which the hydraulic pump 2 is mounted. The socket 17 is connected to the electric motor 3 at the front side of its flange 13. The positioning of the electric motor 3 and the hydraulic pump 2 is such that the motor axis and pump axis are aligned with each other. The socket 17 has an opening through which the electric motor 3 and the hydraulic pump 2 are directly coupled by means of an appropriate shaft arrangement.

The two fluid connections 18, 19 of the pressure supply unit are located on the housing part 4 at a level above the partition base 5. One of the two connections, namely the "tank connection" 18, opens directly into the reservoir 1, wherein the backflowing hydraulic fluid is fed into the reservoir 1 at a position remote from the suction point of the hydraulic pump 2 via a pipe arrangement 20 in order to support circulation of the hydraulic fluid in the reservoir 1. A side wall of the socket 17 having the pressure outlet is directly opposite the housing part 4, so that the pressure connection 19 of the pressure supply unit communicates directly with the pressure outlet of the socket 17. (However, in the case of reversible pressure supply units, both connections lead to the line and valve arrangement accommodated in the socket.)

In addition to the electric motor 3, motor compartment 7 accommodates further electrical components K, in particular a transformer-, switching- and control-group 21, which does not serve the operation of the pressure supply unit, and which is coupled in a heat-conducting manner to a wall portion that laterally delimits motor compartment 7. The cooling fins 12 arranged on the outside of the housing shell 11 extend (also) over the mounting point of the transformer-, switching- and control-group 21. A media-tight bushing 23 is provided in the housing shell 11 for the electrical supply of the electric motor 3 of the pressure supply unit and the transformer-, switching- and control-group 21 as well as for control and signal lines 22.

Figure 4:
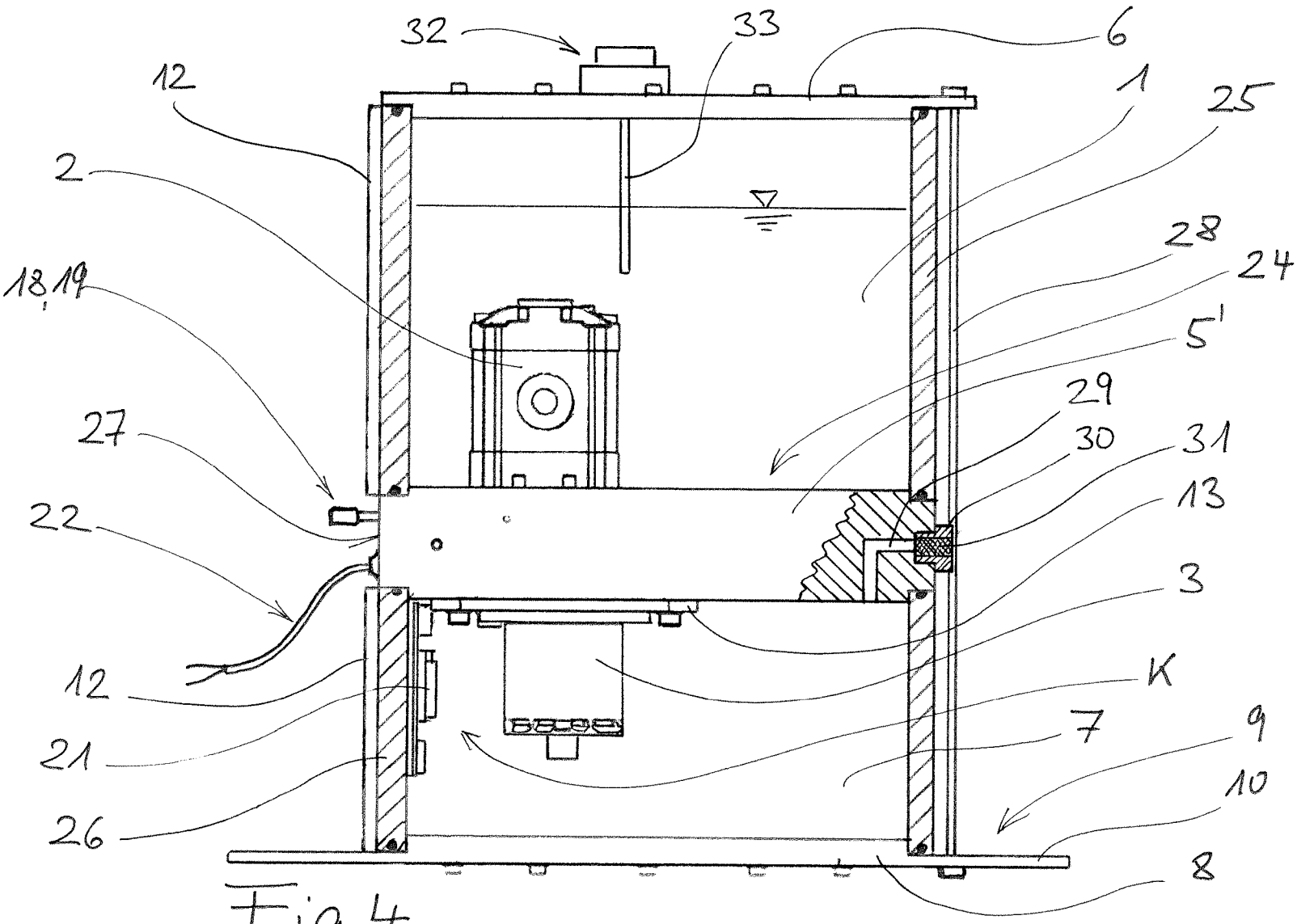
FIG. 4 is a section of the pressure supply unit according to a second preferred embodiment.

The second preferred embodiment of a hydraulic pressure supply unit according to the present invention shown in FIG. 4—in deviation from the first embodiment explained above—is characterized in particular by the fact that here the partition base 5' is configured in the manner of a carrier plate 24. It consists of aluminum. The hydraulic pump 2 is directly attached to it at the top and the electric motor 3 at the bottom. In addition, the hydraulic functionalities, which are accommodated in the socket 17 in the first embodiment, are integrated into it by means of appropriate built-in elements (channels, lines, throttles, valves, filters, etc.). And also a line useful for optimum circulation of the hydraulic fluid in reservoir 1 (cf. pipe arrangement 20 according to the first embodiment) is integrated into the carrier plate separation base 5'.

A first housing part 25, which laterally delimits the hydraulic fluid reservoir 1, is attached to the top of the carrier plate partition base 5' and a separate second housing part 26, which laterally delimits the motor compartment 7, is attached to the bottom. Between the two housing parts 25, 26 the carrier plate partition base 5' is accessible at the circumference; on the circumferential surface 27 both hydraulic connections 18, 19 and—illustrated by line 22—the electrical supply and control connections are provided.

As illustrated, the unit consisting of carrier plate partition base 5', upper and lower housing parts 25, 26 and upper and lower cover 6, 8 can be held together, for example, via external tie rods 28.

Two further special features of the pressure supply unit according to the second embodiment can be seen in FIG. 4. Firstly, the motor compartment 7 is not hermetically sealed. Rather, the partition base 5' has a ventilation hole 29, which communicates on the one hand with the motor compartment 7 and on the other hand with the environment and thus enables a gas exchange between the motor compartment 7 and the environment. The ventilation hole 29 is covered by a cap 30, which is equipped with a Goretex® insert 31. This ensures that moisture—in the form of vapour—can escape from the motor compartment 7 to the outside, while at the same time effectively preventing foreign objects and/or moisture from entering the motor compartment 7 through the ventilation hole. This makes the pressure supply unit particularly suitable for the target application, namely as a hydraulic aggregate for hydraulic steering drives of watercraft.

Furthermore, FIG. 4 shows a filling micrometer 32 which is equipped with an oil level dipstick 33 and closes an oil filling opening in the upper cover 6.

In addition, the pressure supply unit according to the second embodiment is understandable for the skilled person from the above explanations of the embodiment according to FIGS. 1 to 3, so that further explanations are not necessary.

The invention claimed is:

1. A hydraulic pressure supply unit, comprising:

a continuous single piece tubular housing shell, the housing shell having a continuous side wall portion extending between an upper end and a lower end;

a partition base inserted into the tubular housing shell and connected in a heat-conducting manner to an inner surface of the side wall portion of the housing shell between the upper and lower ends of the housing shell such that the side wall portion of the housing shell extends both upwardly and downwardly from the partition base, the partition base having an upper side and a lower side;

a hydraulic fluid reservoir having a stored hydraulic fluid therein, the hydraulic fluid reservoir being circumferentially delimited by the side wall portion of the housing shell, the upper side of the partition base delimiting the hydraulic fluid reservoir and being constantly wetted with the stored hydraulic fluid;

a separate motor compartment located below the hydraulic fluid reservoir, the motor compartment being dry and not in fluid communication with the hydraulic fluid reservoir, the side wall portion of the housing shell circumferentially delimiting the motor compartment;

a hydraulic pump arranged within the hydraulic fluid reservoir and at least partially immersed in the stored hydraulic fluid;

an electric motor driving the hydraulic pump, the electric motor being arranged below the hydraulic pump in the motor compartment, the electric motor being coupled in a heat-conducting manner to the partition base; and at least one electrical component accommodated in the motor compartment and coupled in a heat-conducting manner to the inner surface of the side wall portion of the housing shell laterally delimiting the motor compartment.

2. The hydraulic pressure supply unit according to claim 1, wherein the housing shell has cooling fins on its outside.

3. The hydraulic pressure supply unit according to claim 1, wherein the housing shell has a cylindrical shape.

4. The hydraulic pressure supply unit according to claim 1, wherein the housing shell is closed at the upper and lower ends by means of two covers.

5. The hydraulic pressure supply unit according to claim 4, wherein at least one of the covers is configured as a mounting plate and has at least one fastening portion extending radially beyond the housing shell.

6. The hydraulic pressure supply unit according to claim 5, wherein the at least one fastening portion is a flange.

7. The hydraulic pressure supply unit according to claim 1, wherein the hydraulic pump is mounted on a socket with an integrated line and valve arrangement.

8. The hydraulic pressure supply unit according to claim 7, wherein a projection of the socket passes through an opening in the partition base.

9. The hydraulic pressure supply unit according to claim 8, wherein the electric motor has a flange connected to a front side of the socket projection.

10. The hydraulic pressure supply unit according to claim 9, wherein the flange is fixed to the lower side of the partition base.

11. The hydraulic pressure supply unit according to claim 7, wherein a side wall of the socket has a pressure outlet opposite the side wall portion delimiting the hydraulic fluid reservoir, the pressure outlet of the socket communicating with a pressure connection provided on the the side wall portion delimiting the hydraulic reservoir.

12. The hydraulic pressure supply unit according to claim 1, wherein an axis of the motor and an axis of the pump are aligned with each other.

13. The hydraulic pressure supply unit according to claim 1, wherein the at least one electrical component is coupled in a heat-conducting manner to the partition base.

* * * * *